US007625441B2

(12) United States Patent
Gagnon et al.

(10) Patent No.: US 7,625,441 B2
(45) Date of Patent: Dec. 1, 2009

(54) PAPER COATING FORMULATION HAVING A REDUCED LEVEL OF BINDER

(75) Inventors: Richard Gagnon, St. Louis, MO (US); Donald Hiscock, St. Louis, MO (US)

(73) Assignee: Solae, LLC, St. Louis, MO (US)

( * ) Notice: Subject to any disclaimer, the term of this patent is extended or adjusted under 35 U.S.C. 154(b) by 683 days.

(21) Appl. No.: 11/054,465

(22) Filed: Feb. 9, 2005

(65) Prior Publication Data

US 2006/0174801 A1 Aug. 10, 2006

(51) Int. Cl.
*C09D 103/00* (2006.01)
*C09D 7/00* (2006.01)

(52) U.S. Cl. ..... 106/31.96; 106/157.7; 106/157.8; 106/159.1; 106/501.2

(58) Field of Classification Search ..... 106/31.96, 106/157.7, 157.8, 159.1, 501.1, 501.2
See application file for complete search history.

(56) References Cited

U.S. PATENT DOCUMENTS 3,337,482 A * 8/1967 Watanabe et al. ..... 524/26
4,091,130 A 5/1978 Shaw ..... 427/358
4,265,969 A * 5/1981 Yasuda et al. ..... 428/342
4,421,564 A 12/1983 Graham et al. ..... 106/154 R
4,837,087 A * 6/1989 Floyd et al. ..... 428/511
4,961,788 A 10/1990 Krinski et al. ..... 106/154
4,963,604 A 10/1990 Coco et al. ..... 524/17
4,997,682 A 3/1991 Coco ..... 427/362
5,462,593 A 10/1995 Poppe et al. ..... 106/124
5,766,331 A 6/1998 Krinski et al. ..... 106/157.2
6,291,559 B1 9/2001 Krinski et al. ..... 524/17

FOREIGN PATENT DOCUMENTS

JP 51109032 A * 9/1976
JP 07090799 A * 4/1995

OTHER PUBLICATIONS

Translation to JP 51109032 (Sep. 1976).*
Translation JP 07090799 (Apr. 1995).*

* cited by examiner

*Primary Examiner*—Kelechi C Egwim
(74) *Attorney, Agent, or Firm*—James L. Cordek; Holly M. Amjad

(57) ABSTRACT

Paper coating formulations having a reduced level of binder and processes for their manufacture are disclosed. Specifically, the paper coating formulations comprise a paper coating pigment and a binder. The binder comprises a strongly associated adhesive material that can bind to the other components, such as pigments, that is less prone to depletion from paper coating formulations into a paper web during use.

12 Claims, No Drawings

PAPER COATING FORMULATION HAVING A REDUCED LEVEL OF BINDER

BACKGROUND OF THE INVENTION

The present invention generally relates to a paper coating formulation having a reduced amount of binder as compared to conventional paper coating formulations and methods for making such paper coating formulations. More particularly, the present invention relates to binder for use in paper coating formulations comprising a strongly associated adhesive material, which binds to other coating components, such as pigments, that is less prone to depletion from paper coating formulations into a paper web during use. Specifically, the strongly associated adhesive material prevents other components of the paper coating formulation from moving from the coating formulation into the paper web during the paper coating process. As a result, a reduced level of total binder is needed for the paper coating formulation.

Pigment containing paper coating formulations provide paper with a desirable finish, gloss, and smoothness. A pigment containing paper coating is typically an aqueous mixture of pigment(s) and a binder or adhesive, which is applied to paper. The pigment in the coating fills in irregularities in the paper surface, produces an even and uniformly absorbent surface for printing, and improves the overall appearance of the coated sheet.

The binder or adhesive influences the properties of the coating mixture and the properties of the final coated paper. For example, the binder functions: (1) to impart the required rheology behavior and water retention to the coating mixture; (2) to bind the pigment particles together in the dried coating and to the paper web; and (3) to control the absorption of printing ink during printing on the paper.

The unique functional properties of paper are derived through the paper making process and coating formulations. Predictable performance for the end user is critical, and depends on a consistent composition of the basesheet and coating layer. One major complaint of coated paper producers is that paper properties are inconsistent. Variations in sheet gloss, pick strength, and fiber coverage appear in some cases to be time dependent; with acceptable properties achieved early in a paper processing run and declining as the run continues. Reduction in gloss potential can result in decreased productivity through finishing processes. Poor fiber coverage and pick strength can bring complaints from printers.

One theory concerning declining properties is that the composition of the paper coating can change over time as a result of application and metering processes. Specifically, paper coatings begin to lose water content as soon as they are applied to a paper web. The extent of the loss is dependent upon the absorbency of the substrate, the pressure applied to the coating during application, and the length of time between application and metering of excess coating in the process. Additionally, coating components that are soluble in water or highly mobile are depleted from the coating over time, a result of moving with the water into the paper web.

Consequently, the composition of excess coating returned to the machine supply can differ significantly from that which was originally applied. The binder, in particular, can rapidly deplete and must be consistently replenished by the addition of fresh coating to the supply.

From a practical standpoint, depletion of the binder is economically undesirable. Furthermore, it is desirable to use the minimum amount of binder required to obtain satisfactory cohesion of coating components and their adhesion to paper.

Any amount of binder used above the minimum amount is generally objectionable as it leads to reduced brightness and hiding power, more difficult calendering of the paper, and increased costs.

As such, a need exists in the industry for a paper coating that is strongly-associating with other coating components thus reducing binder depletion during the paper coating process. Additionally, it would be desirable if the paper coating formulation comprised a reduced level of total added binder to reduce costs.

SUMMARY OF THE INVENTION

In one embodiment, the present invention provides paper coating formulations for use in a paper coating process. These formulations include a binder comprising a strongly associated adhesive material, which is less readily depleted from the coating formulation into the paper web during a paper coating process. Formulations using a strongly associated adhesive material require a reduced level of total binder. The present invention also provides methods for preparing the paper coating formulations.

As such, the present invention is directed to a paper coating formulation. The paper coating formulation comprises from about 70% (by total weight solids) to about 97% (by total weight solids) paper coating pigment and from about 2.5% (by total weight solids) to about 10% (by total weight solids) binder, wherein the binder comprises from about 65% (by total weight binder) to about 99% (by total weight binder) strongly associated adhesive material.

The present invention is further directed to a process for making a paper coating formulation. The process comprises providing a paper coating pigment; providing from about 2.5 parts (per hundred parts pigment) to about 12 parts (per hundred parts pigment) binder comprising from about 65% (by total weight binder) to about 99% (by total weight binder) strongly associated adhesive material; and mixing the binder and the paper coating pigment to form the paper coating formulation.

The present invention is further directed to a process for coating paper with a paper coating formulation having a reduced amount of binder. The process comprises providing a paper coating pigment; providing from about 2.5 parts (per hundred parts pigment) to about 12 parts (per hundred parts pigment) binder comprising from about 65% (by total weight binder) to about 99% (by total weight binder) of a strongly associated adhesive material; mixing the binder and the paper coating pigment to form the paper coating formulation; and applying the paper coating formulation to paper.

Other features and advantages of this invention will be in part apparent and in part pointed out hereinafter.

DETAILED DESCRIPTION OF THE PREFERRED EMBODIMENTS

The present invention is generally directed to a paper coating formulation including a binder that comprises a significant amount of strongly associated adhesive material. Specifically, the present invention relates to a paper coating formulation having a strongly associated adhesive material, which is retained to a higher degree than conventional (non-associating or soluble) adhesives during the paper coating process. As these formulations comprise a binder comprising an increased amount of strongly associated adhesive material, the total amount of binder required is reduced. This results in a lower cost to the coating formulation manufacturers and the coated paper producers. In a preferred embodiment, the strongly associated adhesive material is a soy protein concentrate or a soy protein isolate.

Typically, paper coating formulations are prepared by dispersing a paper coating pigment in a first aqueous solution, dispersing an adhesive or binder in a second aqueous solution, and then mixing the two aqueous solutions together. Generally, paper coating formulations comprise from about 40% (by weight formulation) to about 70% (by weight formulation) total non-volatile solids, with the balance being water. The amount of total solids in a paper coating formulation can affect the physical properties of the final coated paper product. The application of paper coatings containing as high in weight percent solids as is practical improves smoothness, gloss, and print quality. Additionally, the rheological properties of aqueous paper coatings are directly influenced by solids content, which in turn directly affects coating processes. For example, when the solids content of coating formulation is increased, the viscosity of the coating formulation is increased. This can effect the speed of the coating machine, as well as energy requirements to dry coating/paper structures.

As noted above, in one embodiment the paper coating formulations described herein comprise a paper coating pigment and a binder. Paper coating pigments suitable for use in the paper coating formulations of the present invention are well known to those skilled in the art and disclosed, for example, in U.S. Pat. No. 6,030,443, issued to Bock, et al. (Feb. 29, 2000) and U.S. Pat. No. 5,766,331, issued to Krinski, et al. (Jun. 16, 1998), both of which are incorporated in their entirety by reference.

As noted above, the mentorp or pigments in the paper coating formulation fills in irregularities in the paper surface. This results in an even and uniformly absorbent surface for printing and improves the overall appearance of the coated sheet. The choice of pigments to be used in the paper coating formulations described herein is based on the resulting properties desired in the paper surface. Suitable exemplary pigments for use in the paper coating formulation of the present invention include calcium carbonate (synthetic, precipitated material, or ground from naturally occurring mineral), calcined kaolin, hydrous kaolin, China clay, talc, mica, dolomite, silica, silicates, zeolite, gypsum, satin white, titania, titanium dioxide, calcium sulphate, barium sulfate, aluminum trihydrate, lithopone, blanc fixe, plastic pigment, and combinations thereof.

Typically, the pigment is present in the paper coating formulation in an amount of from about 70% (by total weight solids) to about 97% (by total weight solids). More suitably, the pigment is present in the paper coating formulation in an amount of from about 80% (by total weight solids) to about 97% (by total weight solids). Generally, the amount of pigment present in the paper coating formulations described herein is not critical and may vary greatly depending upon the desired properties in the final paper. One skilled in the art can easily determine a suitable amount of pigment for a desired application based on the disclosure herein.

In addition to the pigment, the paper coating formulations of the present invention comprise a binder. As described herein above, the binder influences the properties of the paper both during the paper coating process and after the coating process, when printing processes are run. Specifically, during the paper coating process, the binder provides cohesion of all coating components in the dried coating and adhesion of the coating to the paper web. Further, the binder, along with water, serves as a carrier for the pigment and influences the rheologic behavior and water retention of the coating mixture.

Typically, smaller components (i.e., components having a size of 120-220 nanometers) and those that are water-soluble diffuse with water into the paper web, while components of a larger size (and those that are strongly associating) remain in the coating matrix. This results in an overall change to the composition of the paper coating formulation over time. After a certain period of time, the composition of the paper coating formulation may no longer meet the standards recognized in the coated paper processing art, which results in a lower quality of paper. Specifically, the printability and strength of the paper is degraded and does not meet commercial standards.

In response to this problem, producers of coated paper include excess binder in the paper coating formulations. For example, if a paper coating formulation requires 10% (by total weight solids) binder to meet the strength and print quality needs in practice, as much as 12% to 15% (by total weight solids) binder may be added to the formulation to ensure that the paper produced throughout a given production run will have adequate strength despite the seeming inevitable loss of adhesive to depletive processes. This is equivalent to an addition of from 20% to 33% more adhesive than needed. As stated above, this is expensive and further can lead to reduced brightness and hiding power and more difficult calendering of the paper.

It has been discovered in the present invention that less binder is lost, and thus less binder is required in the coating formulation, if the binder utilized in the paper coating formulation comprises at least a certain amount of a strongly associated adhesive material. When a certain amount of strongly associated adhesive material is utilized, the cost of the paper coating formulations may decrease.

Conventionally, paper coating formulations have included binder in an amount of from about 5% (by total weight solids) to about 50% (by total weight solids), more typically, from about 5% (by total weight solids) to about 20% (by total weight solids). However, as stated above, the paper coating formulations of the present invention need comprise only from about 2.5% (by total weight solids) to about 10% (by total weight solids) binder comprising a strongly associated adhesive material. More suitably, the paper coating formulation of the present invention comprises from about 2.5% (by total weight solids) to about 8.0% (by total weight solids) binder; even more suitably, the paper coating formulation comprises from about 2.5% (by total weight solids) to about 4.0% (by total weight solids) binder; and even more suitably, the paper coating formulation comprises about 2.5% (by total weight solids) binder. As such, there is a reduction in the amount of binder as compared to the amount typically used in the paper coating industry.

Without being bound to a specific theory, it is believed that the reduction in the amount of binder required in the paper coating formulation of the present invention is a result of the binder comprising a certain amount of a strongly associated adhesive material. As noted above, the strongly associated adhesive material resists diffusing and migrating from the coating formulation into the paper web during the paper coating process. This allows for the coating formulation to comprise the same composition throughout the paper processing run.

Typically, the paper coating formulations of the present invention have an overall anionic charge. As the art is practiced today, commonly encountered paper coating components are "net" anionic to prevent agglomeration of individual particles through electrostatic stabilization. The strongly associated adhesive material is typically amphoteric in nature. As used herein, the term "amphoteric" means having the characteristics of both a cationic and an anionic compound. As such, the cationic regions/portions of the strongly associated adhesive material are believed to form strong electrostatic associations with anionically charged components, thereby reducing their mobility during application and metering. While cationic coating materials exist, in practice the handling and introduction of these materials in the paper mill environment presents difficulties. As an example, should these materials be introduced inadvertently to anionic materials, they may form a coagulum that would plug lines, storage tanks or process equipment, and be difficult to remove. The present invention uses a material that, while it is amphoteric, is in fact net anionic. This enables its use in common paper-coating formulations without concerns regarding dispersion stability.

Suitable strongly associated adhesive materials for use as binders in the present invention include, for example, proteins, amphoteric latexes, amphoteric starches, gums, resins, and combinations thereof. Preferred strongly associated adhesive materials include soy protein concentrates and soy protein isolates.

Proteins are complex, high molecular weight organic compounds consisting of amino acids joined by ionic bonds. Generally, amino acids have both cationic and anionic properties (i.e., amphoteric). By comprising both a cationic portion and an anionic portion, the amino acids provide the protein with an amphoteric nature, and are capable of binding to the other anionic components in the coating formulation.

In addition to the electrostatic associations, proteins, such as soy protein, remain in the coating formulation due to their relatively high molecular weight. Typically, proteins, such as soy protein polymers used in paper coating applications, will have an estimated molecular weight between 10,000 and 500,000 Daltons. Having a high molecular weight keeps the protein, and the components bound to the protein, from diffusing with water into the paper web during the paper coating process.

Various proteins are suitable for use in the binder of the present invention. As noted above, particularly preferred are soy proteins, generally used in the form of soy protein concentrates and/or soy protein isolates. When dispersed in aqueous paper coatings, soy proteins exist as hydrated polymers. Essentially, the soy proteins are amorphous and possess high orders of structure, providing these materials with exceptional water holding without the development of excessive low shear viscosity. Suitable soy protein sources for the present invention include soy protein concentrates, soy protein isolates, and combinations thereof.

Soy protein concentrates and soy protein isolates are produced by soy flakes. Soy flakes are generally produced by dehulling, defatting, and grinding the soybean and typically contain less than about 65% (by weight dry basis) soy protein. Soy flakes also contain soluble carbohydrates, insoluble carbohydrates such as soy fiber, and fat inherent in soy. Soy flakes may be defatted, for example, by extraction with hexane.

Soy protein concentrates typically contain about 65% (by weight dry basis) to about 85% (by weight dry basis) soy protein, with the major non-protein component being fiber. Soy protein concentrates are typically formed from defatted soy flakes by washing the flakes with either an aqueous alcohol solution or an acidic aqueous solution to remove the soluble carbohydrates from the protein and fiber. Soy protein concentrates suitable for use in the paper coatings will comprise from about 75% (by weight dry basis) to about 85% (by weight dry basis) protein.

Particularly preferred for use as the strongly associated binder in the present invention are soy protein isolates, as these isolates are more highly refined soy protein materials. Specifically, soy protein isolates are processed to contain at least 90% (by weight dry basis) soy protein and little or no soluble carbohydrates or fiber. Soy protein isolates are typically formed by extracting soy protein and water soluble carbohydrates from defatted soy flakes or soy flour with an alkaline aqueous extractant. The aqueous extract, along with the soluble protein and soluble carbohydrates, is separated from materials that are insoluble in the extract, mainly fiber. The extract is typically then treated with an acid to adjust the pH of the extract to the isoelectric point of the protein to precipitate the protein from the extract. The precipitated protein is separated from the extract, which retains the soluble carbohydrates, and is dried after being adjusted to a neutral pH or is dried without any pH adjustment.

In addition to protein and protein-containing materials, amphoteric latex is suitable for use in the binder of the present invention. Latexes are well known in the paper coating industry and are described, for example, in U.S. Pat. No. 6,733,550 issued to Nygard, et al. (Aug. 10, 2004), which is incorporated in its entirety by reference. As latexes are made with thermoplastic polymers, they provide paper coating formulations with high smoothness, excellent flexibility, and high wet-rub resistance.

Amphoteric latexes will provide the advantages noted above and will further bind the other components of the paper coating formulation, keeping the components from depleting by diffusion with water into the paper web. One suitable method of producing amphoteric latex is by copolymerizing 2 parts of diethylaminoethyl methacrylate with a latex that has been preliminarily obtained by polymerizing a monomer mixture of styrene, butadiene, and methacrylic acid, as described in U.S. Pat. No. 4,778,711 issued to Hosomura, et al. (Oct. 18, 1988), which is incorporated in its entirety by reference.

The strongly associated adhesive material can additionally be amphoteric starches. Starch is commonly used in coating formulations due to its low cost and good working qualities. Specifically, binders comprising starch allow for high brightness and good printing qualities.

In addition to proteins, latexes, and starches, gums and resins can suitably be used in the present invention as the strongly associated adhesive material in the binder. Like starches, gums and resins are typically used as binder due to the low cost. Suitable gums for use in the present invention include cellulose gums such as methyl cellulose gums, carboxymethylcellulose gums, and hydroxyethyl cellulose gums. Suitable resins for use in the present invention include water soluble resins such as water soluble vinyl resins of acrylic acid, acrylamide, and acrylonitrile.

Suitably, the strongly associated adhesive material is present in the binder of the present invention in an amount of from about 65% (by total weight binder) to about 99% (by total weight binder). More suitably, the strongly associated adhesive material is present in the binder of the present invention in an amount of from about 96% (by total weight binder) to about 99% (by total weight binder).

In addition to the strongly associated adhesive material, the binder of the present invention can also include emulsion polymers. One suitable emulsion polymer for use in the present invention is latex. As noted above, latexes provide paper coating formulations with high smoothness, excellent flexibility, and high wet-rub resistance.

Additionally, the binder of the present invention can include starches. As noted above, starches provide paper with high brightness and good printing qualities. Suitable starches for use in the binder of the present invention include corn starch, tapioca, white potato, sorghum, waxy corn, waxy sorghum, sweet potato, rice, and wheat starch.

The binder of the present invention can further include casein. Casein is a by-product of the dairy industry and is prepared from skim milk by coagulation in the form of a curd. Generally, the casein is coagulated by acid coagulation, natural souring, or rennet coagulation. To effect acid coagulation of casein, a suitable acid, preferably hydrochloric acid, is added to milk to lower the pH of the milk to about the isoelectric point of the casein, preferably a pH of about 4.0 to about 5.0, and more preferably to a pH of about 4.6 to about 4.8. To effect coagulation by natural souring, milk is held in vats to ferment, causing lactic acid to form. The milk is fermented for a sufficient period of time to allow the formed lactic acid to coagulate a substantial portion of the casein in the milk. To effect coagulation of casein with rennet, sufficient rennet is added to the milk to precipitate a substantial portion of the casein in the milk. Binders comprising casein provide high water resistance to paper coating formulations.

Binders of the present invention can additionally comprise polyvinyl alcohol in combination with the strongly associated adhesive. Using polyvinyl alcohol in the binder of the present invention can allow for high pigment bonding strength, high brightness and gloss, good printability, and water resistance.

In addition to the pigment and binder, the paper coating formulation of the present invention can include additives selected from the group consisting of eveners, lubricants, defoamers, wetting agents, optical brighteners, emulsifiers, biocides, pigment-dispersing agents, cross-linkers, water retention aids, viscosity modifiers or thickeners, and combinations thereof.

In addition to paper coating formulations, the present invention is further directed to processes of making paper coating formulations having a reduced level of binder. In one suitable embodiment, the process comprises: (1) providing a paper coating pigment; (2) providing from about 2.5 parts (per hundred parts pigment) to about 12 parts (per hundred parts pigment) binder comprising from about 65% (by total weight binder) to about 99% (by total weight binder) strongly associated adhesive material; and (3) mixing the binder and the paper coating pigment to form the paper coating formulation.

As noted above, the processes for making paper coating formulations having a reduced level of binder comprise providing a paper coating pigment. The paper coating pigments suitable for use in the present invention can typically include minerals, such as calcium carbonate, calcined kaolin, hydrous kaolin, China clay, talc, mica, dolomite, silica, silicates, zeolite, gypsum, satin white, titania, titanium dioxide, calcium sulphate, barium sulfate, aluminum trihydrate, lithopone, blanc fixe, plastic pigment, and combinations thereof.

In addition to providing a pigment, the processes for making a paper coating formulation of the present invention comprise providing a binder. The binder comprises a strongly associated adhesive material to allow for improved binding between the other components of the paper coating formulation and to the paper web. As noted above, the strongly associated adhesive material can suitably be selected from proteins, amphoteric latexes, amphoteric starches, gums, and resins. Particularly preferred strongly associated adhesive material are soy proteins, even more preferred are soy protein concentrates and soy protein isolates. These materials are amphoteric and can strongly bind to the other components of the paper coating formulation through electrostatic bonding.

Suitably, the binder of the present invention comprises from about 65% (by total weight binder) to about 99% (by total weight binder) strongly associated adhesive material. More suitably, the binder of the present invention comprises from about 96% (by total weight binder) to about 99% (by total weight binder) strongly associated adhesive material.

In addition to the strongly associated adhesive material, the binder of the present invention can suitably further comprise an additive selected from the group consisting of emulsion polymers such as latexes, starches, casein, polyvinyl alcohol, and combinations thereof. Suitable starches for use in the present invention include corn starch, tapioca, white potato, sorghum, waxy corn, waxy sorghum, sweet potato, rice, and wheat starch.

Generally, when processing paper coating formulations, binder is provided in the formulation in terms of "parts per hundred parts of pigment". Typically, paper coating formulations are comprised of from about 5 parts (per hundred parts pigment) to about 25 parts (per hundred parts pigment) binder.

The binder of the present invention, however, is provided in the coating formulation in an amount of from about 2.5 parts (per hundred parts pigment) to about 12 parts (per hundred parts pigment). More suitably, the binder is provided in the coating formulation in an amount of from about 2.5 parts (per hundred parts pigment) to about 8.7 parts (per hundred parts pigment); more suitably from about 2.5 parts (per hundred parts pigment) to about 4.25 parts (per hundred parts pigment); even more suitably, about 2.5 parts (per hundred parts pigment). This is a reduction of about 50% binder in the paper coating formulation.

Once the pigment and the binder are provided, the two are mixed together to form the paper coating formulation. Preparation of paper coating formulations are well known in the art and disclosed, for example, in U.S. Pat. No. 5,766,331 issued to Krinski, et al. (Jun. 16, 1998) and U.S. Pat. No. 4,421,564 issued to Graham, et al. (Dec. 20, 1983), both of which are incorporated in their entirety by reference. In one embodiment, the paper coating formulation is formed by dispersing the binder ingredients and the pigment separately in aqueous solutions comprising water. Once the binder and pigment are sufficiently dispersed, the binder and pigment are mixed together to provide a slurry having a solids content of at least about 36% by weight of the slurry, and more suitably from about 38% to about 44% by weight of the slurry.

Typical amounts of paper coating pigment that may be employed in preparation of the coating formulation of the present invention are from about 65% (by weight of the slurry) to about 78% (by weight of the slurry). Pigments constitute the principle ingredient for control of the solids level in the coating formulation of the present invention. As noted above, a paper coating formulation typically comprises from about 70% (by total weight solids) to about 97% (by total weight solids) paper coating pigment.

Following dispersion of the mineral pigment with the binder in the aqueous solution, the pH of the slurry is controlled to a defined level of from about 7.0 to about 10.0, and more suitably from about 8.0 to about 9.0. The pH of the slurry prior to any adjustment will in great part be influenced by the pH of the slurry comprising the binder and the paper coating pigment. Adjustment of pH in the process of the present invention is most commonly accomplished through the addition of either sodium hydroxide or ammonium hydroxide (aqueous ammonia).

The process of the present invention may further comprise adding an additive selected from the group consisting of eveners, lubricants, defoamers, wetting agents, optical brighteners, emulsifiers, biocides, pigment-dispersing agents, cross-linkers, water retention aids, viscosity modifiers or thickeners, and combinations thereof.

In another embodiment, the present invention is directed to the method of making a paper coating formulation as described above and further comprises applying the paper coating formulation to paper. Generally, the paper coating formulation can be applied to one or more sides of the paper by any means known in the art. For example, paper coating methods include, but are not limited to, roll applicator and metering with roll, rod, blade, bar, air knife; pond applicator and metering with roll, rod, blade, bar, or air knife; fountain applicator and metering roll with roll, rod, blade, bar, or air knife; pre-metered films or patterns, such as gate roll, three-roll, anilox, gravure, film press, curtain, spray); and foam application. In one embodiment, the paper is fed through rollers that have been coated with the paper coating formulation. The coating formulation is transferred to the paper surface under pressure. The thickness of the formulation is controlled by, among other factors, the thickness of the coating formulation applied to the rollers. The present invention has greatest value in cases where coating is applied to the paper web under pressure and in excess with that excess subsequently metered and returned to the machine supply.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

While the invention has been explained in relation to its preferred embodiments, it is to be understood that various modifications thereof will become apparent to those skilled in the art upon reading the description. Therefore, it is to be understood that the invention disclosed herein is intended to cover such modifications as fall within the scope of the appended claims.

What is claimed is:

1. A paper coating formulation comprising from about 70% (by total weight solids) to about 97% (by total weight solids) paper coating pigment and from about 2.5% to about 10% (by total weight solids) binder, wherein the binder comprises from about 65% (by total weight binder) to about 99% (by total weight binder) strongly associated adhesive material, wherein the strongly associated adhesive material is a soy protein selected from the group consisting of a soy protein concentrate, a soy protein isolate, and combinations thereof and at least one of an amphoteric latex and an amphoteric starch.

2. The paper coating formulation as set forth in claim 1 wherein the formulation comprises from about 2.5% (by total weight solids) to about 4% (by total weight solids) binder.

3. The paper coating formulation as set forth in claim 1 wherein the binder comprises from about 96% (by total weight binder) to about 99% (by total weight binder) strongly associated adhesive material.

4. The paper coating formulation as set forth in claim 1 wherein the binder further comprises an additive selected from the group consisting of emulsion polymers, starches, casein, polyvinyl alcohol, and combinations thereof.

5. The paper coating formulation as set forth in claim 1 wherein the pigment is selected from the group consisting of calcium carbonate, calcined kaolin, hydrous kaolin, China clay, talc, mica, dolomite, silica, silicates, zeolite, gypsum, satin white, titania, titanium dioxide, calcium sulfate, barium sulfate, aluminum trihydrate, lithopone, blanc fixe, plastic pigment, and combinations thereof.

6. The paper coating formulation as set forth in claim 1 further comprising an additive selected from the group consisting of eveners, lubricants, defoamers, wetting agents, optical brighteners, emulsifiers, biocides, pigment-dispersing agents, cross-linkers, water retention aids, viscosity modifiers or thickeners, and combinations thereof.

7. A process for making a paper coating formulation having a reduced amount of binder, the process comprising:

providing a paper coating pigment;

providing from about 2.5 parts (per hundred parts pigment) to about 12 parts (per hundred parts pigment) binder comprising from about 65% (by total weight binder) to about 99% (by total weight binder) strongly associated adhesive material, wherein the strongly associated adhesive material is a soy protein concentrate, a soy protein isolate, and combinations thereof and at least one of an amphoteric latex and an amphoteric starch; and mixing the binder and the paper coating pigment to form the paper coating formulation.

8. The process as set forth in claim 7 wherein the binder is provided in an amount of from about 2.5 parts (per hundred parts pigment) to about 4.25 parts (per hundred parts pigment).

9. The process as set forth in claim 7 wherein the binder comprises from about 96% (by total weight binder) to about 99% (by total weight binder) strongly associated adhesive material.

10. The process as set forth in claim 7 wherein the binder further comprises an additive selected from the group consisting of emulsion polymers, starches, casein, polyvinyl alcohol, and combinations thereof.

11. The process as set forth in claim 7 wherein the pigment is selected from the group consisting of calcium carbonate, calcined kaolin, hydrous kaolin, China clay, talc, mica, dolomite, silica, silicates, zeolite, gypsum, satin white, titania, titanium dioxide, calcium sulfate, barium sulfate, aluminum trihydrate, lithopone, blanc fixe, plastic pigment, and combinations thereof.

12. The process as set forth in claim 7 further comprising an additive selected from the group consisting of eveners, lubricants, defoamers, wetting agents, optical brighteners, emulsifiers, biocides, pigment-dispersing agents, cross-linkers, water retention aids, viscosity modifiers or thickeners, and combinations thereof.

* * * * *

UNITED STATES PATENT AND TRADEMARK OFFICE

CERTIFICATE OF CORRECTION

PATENT NO. : 7,625,441 B2
APPLICATION NO. : 11/054465
DATED : December 1, 2009
INVENTOR(S) : Gagnon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1100 days.

Signed and Sealed this

Second Day of November, 2010

David J. Kappos

David J. Kappos
*Director of the United States Patent and Trademark Office*